US005191767A

United States Patent [19]

Kane et al.

[11] Patent Number: 5,191,767

[45] Date of Patent: Mar. 9, 1993

[54] GAS TURBINE AIR HANDLING SYSTEM

[75] Inventors: David M. Kane, Darien; William E. Fry, Stamford, both of Conn.

[73] Assignee: Mistop, Inc., East Norwalk, Conn.

[21] Appl. No.: 808,906

[22] Filed: Dec. 17, 1991

Related U.S. Application Data

[63] Continuation-in-part of Ser. No. 610,431, Nov. 7, 1990, Pat. No. 5,074,117.

[51] Int. Cl.[5] ..... F02C 1/02

[52] U.S. Cl. ..... 60/728; 55/269

[58] Field of Search ..... 60/728; 55/269

[56] References Cited

U.S. PATENT DOCUMENTS

| | | | |
|---|---|---|---|
| 3,877,218 | 4/1975 | Nebgen | 60/728 X |
| 3,978,663 | 9/1976 | Mandrin et al. | 60/728 |
| 4,261,169 | 4/1981 | Zimmern | 60/728 X |
| 4,418,527 | 12/1983 | Sohlom et al. | 60/728 X |
| 4,513,577 | 4/1985 | Wilson | 62/281 |
| 4,702,074 | 10/1987 | Munk | 60/728 X |
| 4,896,499 | 1/1990 | Rice | 60/728 X |
| 5,072,592 | 12/1991 | Ishigaki | 55/269 X |

FOREIGN PATENT DOCUMENTS

| | | | |
|---|---|---|---|
| 71213 | 6/1979 | Japan | 60/728 |
| 27034 | 3/1981 | Japan | 60/728 |

OTHER PUBLICATIONS

Koch Engineering Company, Inc., Bulletin, 1974.

Otto H. York Company, Inc., Bulletin, 55A, 1988.

*Primary Examiner*—William E. Tapolcai

*Attorney, Agent, or Firm*—St. Onge Steward Johnston & Reens

[57] ABSTRACT

The invention presented relates to a process and system for removing the moisture from the intake air of a gas turbine. More particularly, the process involves passing the intake air flow through a mesh pad to reduce the moisture level thereof downstream from the means used to cool the air prior to entering the gas turbine compressor.

17 Claims, 2 Drawing Sheets

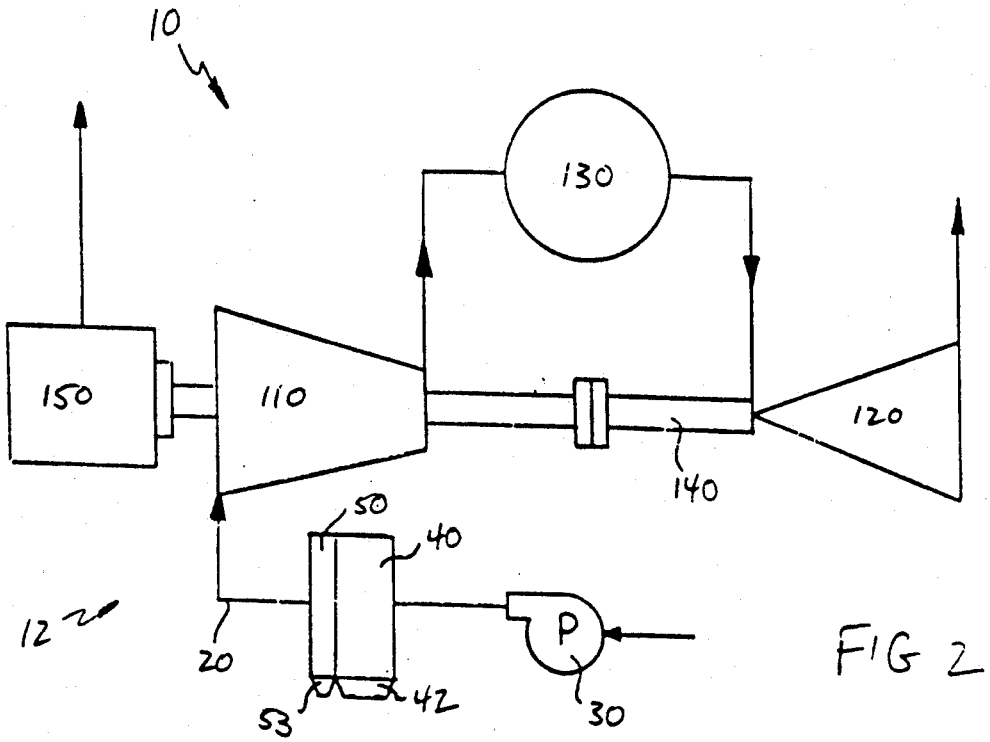
FIG 2
FIG 3
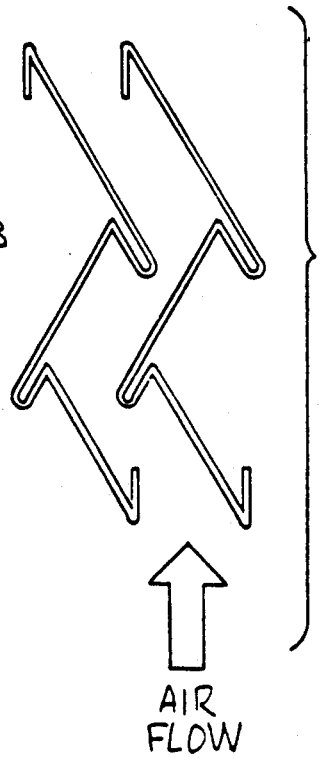
FIG 4
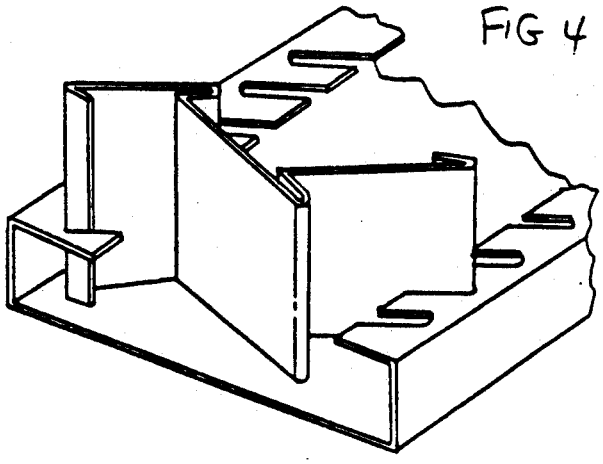

GAS TURBINE AIR HANDLING SYSTEM

RELATED APPLICATION

This application is a continuation-in-part of copending and commonly assigned U.S. patent application entitled "Air Handling System", having Ser. No. 7/610,431 filed in the names of Kane and Fry on Nov. 7, 1990, now U.S. Pat. No. 4,074,117, the disclosure of which is incorporated herein by reference.

DESCRIPTION

Technical Field

The present invention relates to an air handling system for a gas turbine, and a process which is capable of removing the moisture from feed or intake air after cooling. This system comprises a means for reducing the moisture level of the air, comprising a mesh pad disposed downstream from the means used to cool the air prior entry into the compressor of the gas turbine.

Gas turbines have been found to be one of the most satisfactory and efficient means of producing mechanical power in certain situations. They have been found to be highly reliable and their absence of reciprocating and rubbing members means that there are few balancing problems and exceptionally low consumption of lubricating oil. Gas turbines began to become widely utilized in the mid-1950's, and have made progressively greater impact since then in a wide variety of applications.

In operation, a gas turbine compresses a working fluid (i.e., intake air) in order to produce an expansion thereof through a turbine. A power increase is provided by the addition of energy, which raises the temperature of the working fluid prior to expansion. This energy is provided in the form of combustion of a fuel within the compressed working fluid. Expansion of the resulting effluent gases produces a power output from the turbine beyond what is necessary to power the compressor.

In operation, intake air is provided to the gas turbine compressor by a pump or other suitable means which, by its very action, raises the temperature of the intake air. When this occurs, and the intake air temperature raises beyond the point desired for most efficient compression, the air must be cooled before being provided to the compressor. The most often used cooling means for cooling the intake air before being provided to the compressor is a conventional evaporative cooling device. However, such an evaporative cooler is not the only manner in which the intake air can be cooled. For instance, it has recently been suggested that the method of cooling the intake air comprise a cooling coil or series of cooling coils.

Regardless of the means used to cool the intake air, such cooling may result in a disruption of the state of the binary mixture of dry air and water vapor present in the intake air in most climates. This may cause large water droplets (as compared with the size of water vapor droplets) to become entrained in the air flowing into the compressor where condensation can cause damage due to corrosion, erosion, etc., to internal gas turbine surfaces. In addition, it is often desired that water be introduced at the point of combustion of the fuel in order to control pollutant levels and combustion temperatures, but the level of water introduced must be carefully regulated. The presence of large water droplets in the intake air may upset this delicate balance and interfere with the combustion process.

Presently, in order to reduce the moisture level of the cooled intake air, moisture elimination devices generally utilize chevron-style moisture eliminators which rely on the impingement of entrained water droplets on the eliminator surfaces. The droplets then run down the chevron blades, and are collected or drained in suitable apparatus.

These chevron moisture eliminators are generally "three-bend" or "six-bend" type eliminators, and are usually mounted up to six feet from the cooling medium, such as the cooling coils, the evaporative cooler, etc. In most commercial installations, chevron moisture eliminators must be at least 6 inches deep for adequate reduction of entrained water. Typical chevron moisture eliminators and mounting brackets therefor are illustrated in FIGS. 3 and 4. Unfortunately, chevron-type moisture eliminators are difficult and costly to manufacture and install; they lead to a relatively high pressure drop through the system, which is directly translatable to high energy use and reduced efficiency, and thus high operating cost; and they require substantial space, which can often not be accommodated, especially in the case of retrofit installations in an existing system where no additional space is available.

What is desired, therefore, is a gas turbine air handling system which is effective at the cooling and elimination of substantial amounts of carry-over moisture from the intake air flow in a practical and efficient manner.

DESCRIPTION OF INVENTION

The present invention relates to a process and system for cooling and moisture elimination of the intake air in a gas turbine. This process comprises providing a gas turbine system having a compressor, a turbine, and a combustion zone; providing an air passage for providing intake air to the gas turbine compressor; generating a flow of air through the air intake passage; cooling the air flow prior to it being fed into the compressor; and reducing the moisture level of the cooled air by passing the cooled air flow through a knitted mesh pad.

DESCRIPTION OF THE DRAWINGS

The invention will be better understood and its advantages will become more apparent from the following detailed description, especially when read in light of the attached drawings, wherein:

FIG. 2 is a schematic illustration of one embodiment of a gas turbine including a gas turbine air handling system useful in the claimed invention;

FIG. 3 is a partial top plan view of a chevron-type moisture eliminator; and

FIG. 4 is an isometric view of a chevron-type moisture eliminator mounted in a supporting bracket.

DETAILED DESCRIPTION OF THE PREFERRED EMBODIMENT

Figure 1:
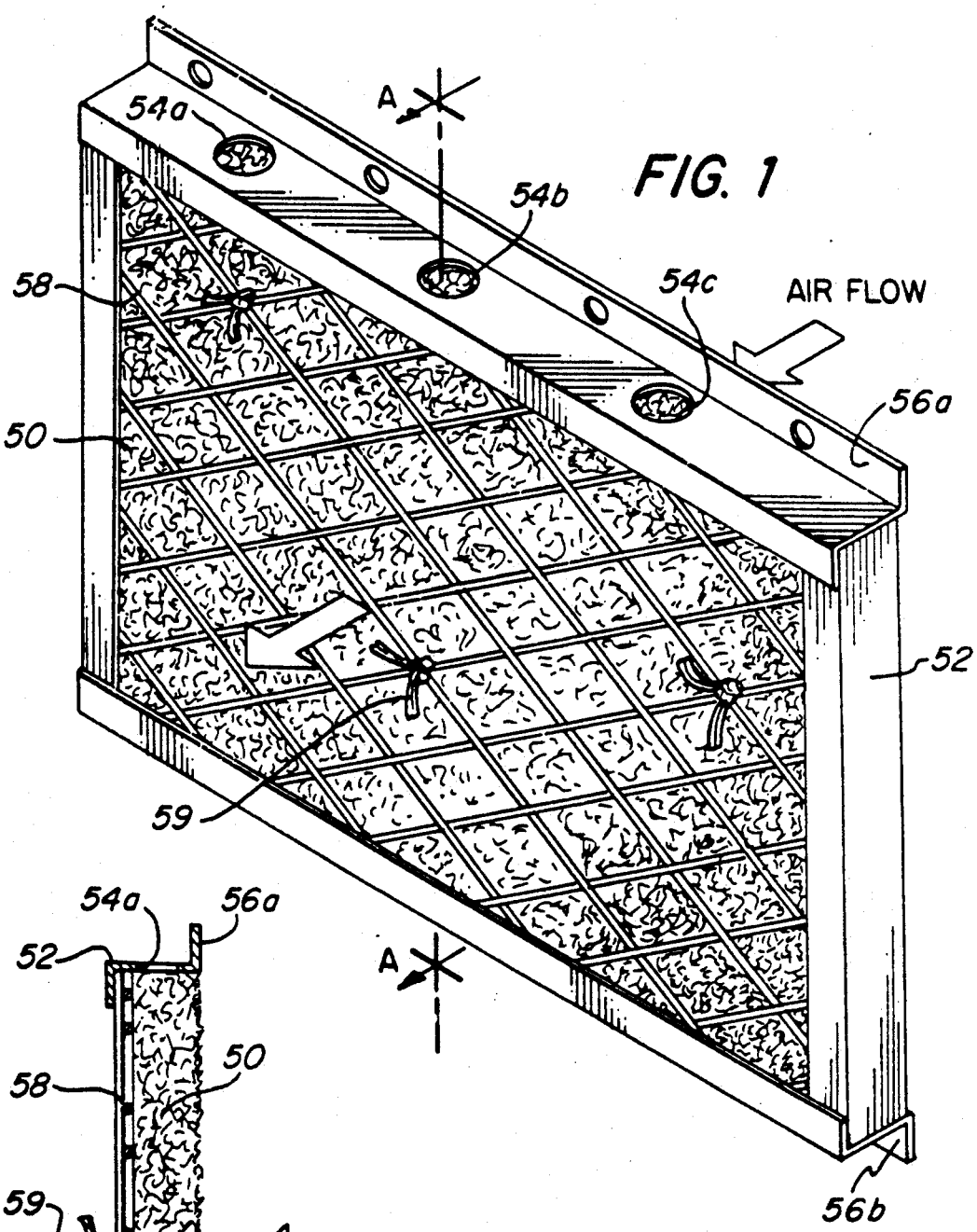
FIG. 1 is an isometric view of a knitted mesh pad moisture eliminator useful in the claimed invention.

Referring to the drawings, a gas turbine having a gas turbine air handling system in accordance with the invention is generally indicated by the reference numeral 10. It should be noted that for the sake of clarity, all the components and parts of gas turbine 10 are not shown and/or marked in all the drawings. In addition, the terms "top" and "bottom" refer to the orientation illustrated in FIG. 1. It will be understood, though, that the illustrated orientation is not necessary for operability of gas turbine 10 or the inventive gas turbine air handling system 12.

As illustrated in FIG. 2, the present invention relates to a process for the cooling and moisture elimination of the intake air in a gas turbine 10, as well as a gas turbine air handling system 12 for effecting the process. This process generally comprises providing a gas turbine 10 having a compressor 110, a turbine 120, and at least one (and generally several, i.e., six) combustion zone (also commonly referred to as a combustion can) 130. Means for providing intake air to the compressor is also provided, and a flow of air is generated through the air intake means. The flow of air is conducted through a means for cooling it and then the moisture level of the cooled air is reduced by passing it through a knitted, mesh pad.

In order to provide intake air to compressor 110, gas turbine 10 comprises a passage 20. Intake air entering compressor 110 through intake passage 20 is compressed within compressor 110 and then provided to combustion zone 130 where fuel is added and combustion occurs, raising the temperature of the air which is then forced into turbine 120 which turns due to the expansion of the exhaust gas exiting combustion zone 130. Turning of turbine 120 causes rotation of shaft 140 which turns the vanes within compressor 110 (not shown) and in turn, supplies energy to generator 150, which comprises the output of gas turbine 10. Exhaust gases exit turbine 120 and can be further utilized, i.e., as pre-heated combustion air for the boiler of a nearby gas plant, etc.

Prior to being supplied to compressor 110 via intake air passage 20, the intake air is brought to an increased pressure to facilitate feeding of the intake air into compressor 110, as would be familiar to the skilled artisan, via pressure means 30. Pressure means 30 can comprise any suitable means for raising the pressure of the intake air such as a fan, centrifugal fan, or supercharger Although the degree to which the pressure of the intake air is increased depends upon the artisan, commonly, the pressure is raised by at least about 40" $H_2O$ in most applications.

The work performed on the intake air by pressure means 30 often raises the temperature of the intake air beyond that which is most efficient for feeding into compressor 110. In these cases, the intake air is passed from pressure means 30 to a cooling means 40 disposed along intake air passage 20. Cooling means 40 can comprise any suitable means for cooling the intake air to a desired level, i.e., generally no higher than about 90° F. The particular temperature to which intake air should be lowered by cooling means 40 will depend upon the skilled artisan and the particular characteristics of gas turbine 10.

The most common means employed to cool the intake air of a gas turbine is an evaporative cooler. In an evaporative cooler, water is applied to a high surface area media. As the intake air passes over or through the media, it takes up some of the water. The air is then cooled by the action of evaporation of the water. Cooling means 40 generally comprises an evaporative cooler. However, other cooling means, such as one or more cooling coils, can be utilized.

A cooling coil generally comprises a conduit through which a cooling medium flows. In order to cool the air with as much efficiency as possible, the air flow is passed across the cooling coil to contact as much surface area of the cooling coil with the air flow as possible. To do so, the cooling coil is advantageously configured as rows of tubes which are staggered or disposed in line with respect to the air flow.

The cooling coil can be of the bare tube or finned tube type through which water, ethylene glycol, propylene glycol, or brine solutions of calcium chloride or sodium chloride are circulated as the cooling medium. In addition, the cooling coil can be of the bare tube or finned tube type through which a refrigerant is circulated as the cooling medium. Typical refrigerants include ammonia, fluorocarbons, and chlorofluorocarbons. In addition, much effort is underway to replace chlorofluorocarbons with more environmentally benign compositions, and they would also be useful in the cooling coil used in the present invention.

The cooling coil can be formed from any suitable water resistant material, including copper, brass, steel, aluminum, and stainless steel, although copper and brass are often preferred due to their strength, resistance to corrosion, and heat transfer qualities.

Another type of cooling means which can be employed as cooling means 40 is a spray coil, which is, in effect, a combination of a cooling coil and an evaporative cooler. In a spray coil, a cooling coil is sprayed with a fluid, which is taken up by the air for evaporative cooling, which assists the cooling coil.

Cooling means 40 generally has associated therewith at least one cooling means draining pan 42 through which water which condenses on cooling means 40 is collected and channeled into suitable storage or disposal means. The temperature of cooling mean 40 should be less than that of the air flow across it, and moisture in the air will tend to condense on cooling means 40 and flow down to drain pan 42. Although much of the moisture in the air can be eliminated this way, excess moisture remains entrained in the air flow after passing across cooling means 40.

The process of the present invention further comprises reducing the moisture level of the cooled air by passing the cooled air flow through an elimination means comprising a knitted, mesh pad 50 which is disposed downstream (usually up to about six feet downstream) from cooling means 40 along intake air passage 20 for greatest efficiency. As its name implies, mesh pad 50 comprises a mass of fibrous strands bunched together in a bundled mass, and is usually prepared by "knitting" of the component fibers.

Because of its nature, "knitted" mesh pad 50 serves to eliminate a substantial portion of the entrained water remaining in the air flow. Although not wishing to be bound by any theory, it is believed that mesh pad 50 captures water vapor or droplets in the air flow by inertial impaction. Dry air passes through mesh pad 50 with relatively little resistance, but the density of mesh pad 50 is such that water vapor or droplets impact thereon and join with others, which then run down to suitable collection or drain means, as discussed in more detail below.

Figure 1A:
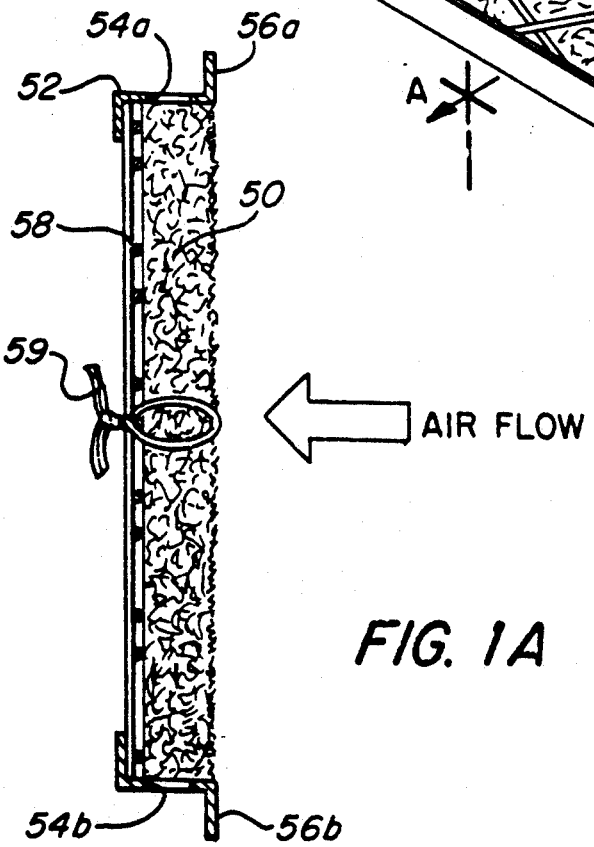
FIG. 1*a* is a cross-sectional view of the moisture eliminator of FIG. 1, taken along lines A—A.

Generally, mesh pad 50 is contained within a frame 52 which can be attached to the discharge end of cooling means 40 (which is usually situated within a suitable housing for containment and direction of the air flow across cooling means 40) or, as noted, downstream thereof. Frame 52, as illustrated in FIGS. 1 and 1*a*, is a suitable retaining means for maintaining mesh pad 50 in position such that the air flow passes through mesh pad 50. Frame 52 is configured in the shape mesh pad 50 is to assume. Advantageously, frame 52 is rectangular in shape since the air flow being discharged from cooling means 40 is usually generally rectangular due to the housing in which the air flows across cooling means 40, which is most often rectangular in shape.

Frame 52 can also comprise holes or ports, 54*a*, 54*b*, 54*c*, 54*d*, etc. for draining of moisture eliminated from the air flow. When frame 52 is attached to the discharge end of cooling means 40, moisture eliminated from the air flow by mesh pad 50 can drain through ports 54*a*, 54*b*, 54*c*, 54*d*, etc. to draining pan 42. Alternatively, whether frame 52 is mounted attached to cooling means 40 or downstream from cooling means 40, moisture can drain to an independent collection or drain means 53. Ports 54*a*, 54*b*, 54*c*, 54*d*, etc. are preferably disposed both at the top and at the bottom of frame 52 to allow an installer to install frame 52 without regard to orientation Ports 54*a*, 54*b*, 54*c*, 54*d*, etc. can be any size or in any suitable number or pattern to adequately pass the moisture eliminated from the air flow to collection or drain means 53. In addition, frame 52 can also comprise attachment flanges 56*a* and 56*b*, which can be used to attach frame 52 (and, therefore, mesh pad 50) to the housing which contains cooling means 40.

Advantageously, as illustrated in FIGS. 1 and 1*a*, frame 52 further comprises a grid or retaining means 58 which is disposed across the downstream side of frame 52 and mesh pad 50. Grid 58 serves to prevent mesh pad 50 from being forced out of frame 52 (and thereby out of optimal position) by the force of the air flow through mesh pad 50. Preferably, grid 58 and mesh pad 50 are attached through means such as ties 59 to assist in the maintenance of mesh pad 50 in position.

Frame 52 is preferably mounted to the housing in which cooling means 40 is situated so as to maintain mesh pad 50 in a generally vertical orientation, since most applications involve passing an air flow which is in a generally horizontal orientation across cooling means 40. A vertical orientation of mesh pad 50 has been found to be most efficient in these situations.

The size of mesh pad 50 and frame 52 will vary depending upon the intake air passage 20 in which it is being disposed, since it is desirable to have mesh pad 50 disposed across the entire air intake passage 20 so that virtually all of the air flow passes through mesh pad 50. Where mesh pad 50 is mounted to the cooling means 40 housing, mesh pad 50 should assume the dimensions of the housing, as described above.

The depth and density of mesh pad 50 of the present invention can vary depending on the anticipated duty. Generally, the depth of mesh pad 50 will be between about 0.5 and about 6 inches, preferably between about 1 and about 3 inches, although greater depth can also be anticipated. The density of mesh pad 50 is preferably about 3 pounds per cubic feet (lbs/ft$^3$) to about 12 lbs/ft$^3$, more preferably about 4 lbs/ft$^3$ to about 6 lb/ft$^3$. It will be recognized that as density increases, depth can decrease and as depth increases, density can decrease. These two factors can be adjusted to provide maximum efficiency with minimum space usage. Frame 52 should, but does not have to, have the same depth as mesh pad 50 for greatest stability.

Generally, mesh pad 50 can be formed of stainless steel, aluminum, copper, or other like metals (or combinations thereof) of various gauges and can also be a suitable non-metallic material like a high density plastic material, fiberglass, or polyethylene. Although any material which is relatively resistant to degradation or corrosion by extensive exposure to moisture can be utilized, it is most advantageous to utilize a metal because it may be undesirable and contrary to local fire protection codes to position a flammable material at the intake of a gas turbine. Typically, mesh gauges are about 0.003 inches to about 0.015 inches for mesh pad 50 of the present invention, more preferably about 0.010 inches to about 0.013 inches, although this can vary depending on the desired mesh density and depth.

Frame 52 in which mesh pad 50 is disposed can likewise be formed of any suitable material resistant to moisture, such as stainless steel, aluminum, galvanized steel, carbon steel, especially with corrosion preventing coatings, as well as non-metallic materials such as a high density plastic, with the required dimensional stability. Similarly, grid 58 disposed across frame 52 for retaining knitted mesh pad 50 in place can also be stainless steel, aluminum, galvanized steel, or a non-metallic material having the required strength.

Since the air flow through mesh pad 50 is essentially straight, there is less resistance to air flow and thus, less pressure drop across mesh pad 50 of the present invention as compared with chevron-type moisture eliminators. In addition, the space required for installation of mesh pad 50 is less than that for chevron eliminators, 3- or 6-bend moisture eliminators which measure 3 inches and 12 inches, respectively. Moreover, installation is generally easier since it usually only requires attachment by screw or other type means of frame 52 containing mesh pad 50 to the housing in which cooling means 40 is situated.

The above description is for the purpose of teaching the person or ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

What is claimed is

1. A gas turbine comprising a compressor, a turbine, a combustion zone, and a generator, wherein said gas turbine further comprises a passage for the supply of intake air to said compressor; means for generating a flow of air through said air intake passage; cooling means disposed within said air intake passage so as to be contacted by the flow of intake air; and elimination means disposed within said air intake passage so as to be contacted by the flow of air after said cooling means is contacted by the flow of air, said elimination means comprising a knitted mesh pad in order to reduce the moisture level of the intake air.

2. The gas turbine of claim 1, wherein said flow means comprises a fan, a centrifugal fan, or a supercharger.

3. The gas turbine of claim 2, wherein said cooling means comprises an evaporative cooler.

4. The gas turbine of claim 2, wherein said cooling means comprises at least one cooling coil comprising a conduit through which a cooling medium flows.

5. The gas turbine of claim 4, wherein said cooling medium comprises a composition selected from the group consisting of water, ethylene glycol, propylene glycol, aqueous calcium chloride solutions, aqueous sodium chloride solutions, refrigerants, and mixtures thereof.

6. The gas turbine of claim 5, wherein said refrigerants comprise ammonia, fluorocarbons, chlorofluorocarbons, and mixtures thereof.

7. The gas turbine of claim 1, wherein said knitted mesh pad comprises a material selected from the groups consisting of stainless steel, aluminum, copper, and combinations thereof.

8. The gas turbine of claim 7, wherein said knitted mesh pad is retained within a frame composed of a material selected from the group consisting of stainless steel, galvanized steel, carbon steel, aluminum, a high density plastic material, and combinations thereof.

9. The gas turbine of claim 8, wherein said cooling means is disposed within a housing and said frame is removably attached to said housing.

10. A process for cooling and removing the moisture from the intake air in a gas turbine which comprises a compressor, a turbine, and a combustion zone, the process comprising:

a) providing a passage for intake of air into the compressor;

b) generating a flow of air through said intake air passage;

c) cooling said air flow by passing it across a cooling means; and d) reducing the moisture level of said cooled air flow by passing said cooled air flow through a knitted mesh pad.

11. The process of claim 10, wherein said cooling means comprises an evaporative cooler.

12. The process of claim 10, wherein said cooling means comprises at least one cooling coil comprising a conduit through which a cooling medium flows.

13. The process of claim 12, wherein said cooling medium comprises a composition selected from the group consisting of water, ethylene glycol, propylene glycol, aqueous calcium chloride solutions, aqueous sodium chloride solutions, refrigerants, and mixtures thereof.

14. The process of claim 13, wherein said refrigerants comprise ammonia, fluorocarbons, chlorofluorocarbons, and mixtures thereof.

15. The process of claim 10, wherein said knitted mesh pad comprises a material selected from the groups consisting of stainless steel, aluminum, copper, and combinations thereof.

16. The process of claim 15, wherein said mesh pad is retained within a frame composed of a material selected from the group consisting of stainless steel, galvanized steel, carbon steel, aluminum, a high density plastic material, and combinations thereof.

17. The process of claim 16, wherein said cooling means is disposed within a housing and said frame is removably attached to said housing.

* * * * *